US005337943A

United States Patent [19]

Hendren

[11] Patent Number: 5,337,943

[45] Date of Patent: Aug. 16, 1994

[54] GIFT WRAP AND METHOD

[75] Inventor: Ronald D. Hendren, Minnetonka, Minn.

[73] Assignee: Universal Technologies, Inc., Minnetonka, Minn.

[21] Appl. No.: 76,175

[22] Filed: Jun. 14, 1993

Related U.S. Application Data

[63] Continuation of Ser. No. 926,554, Aug. 6, 1992, which is a continuation of Ser. No. 667,632, Mar. 11, 1992.

[51] Int. Cl.[5] ..... B65D 65/14

[52] U.S. Cl. ..... 229/87.19; 229/923

[58] Field of Search ..... 229/87.19, 923, 87.18, 229/40

[56] References Cited

U.S. PATENT DOCUMENTS

| | | | |
|---|---|---|---|
| 956,590 | 5/1910 | Markert | 229/87.19 |
| 1,556,056 | 10/1925 | Weeks | 229/87.18 |
| 1,694,701 | 12/1928 | Covel | 229/87.18 |
| 1,827,212 | 10/1931 | Stokes | 229/87.18 |
| 2,047,980 | 8/1936 | Olm et al. | 229/87.18 |
| 2,365,704 | 12/1944 | James | 229/87.19 |
| 2,438,509 | 3/1948 | McGovern | 229/87.19 |
| 2,722,361 | 11/1955 | Kindseth | 229/87.18 |
| 3,381,889 | 5/1968 | Laskow | 229/87.19 |
| 3,394,867 | 7/1968 | Gregg | 229/147 |
| 3,458,112 | 7/1969 | Nelson | 229/87.19 |
| 3,489,333 | 1/1970 | Culberg et al. | 229/87.19 |
| 3,559,876 | 2/1971 | Conescu | 229/87.19 |
| 3,658,240 | 4/1972 | Stoll | 229/87.19 |
| 4,967,952 | 11/1990 | Roessiger | 229/87.19 |

FOREIGN PATENT DOCUMENTS

| | | | |
|---|---|---|---|
| 1335687 | 10/1973 | United Kingdom | 229/87.19 |

*Primary Examiner*—Allan N. Shoap
*Assistant Examiner*—Christopher McDonald
*Attorney, Agent, or Firm*—Nawrocki, Rooney & Sivertson

[57] ABSTRACT

A quickly applied preformed gift wrap to a carton, the wrap having pre-scribed fold lines sequentially numbered for folding about a carton and shielded adhesive strips to secure overlapping edges of the folded portions.

8 Claims, 3 Drawing Sheets

GIFT WRAP AND METHOD

This is a continuation of application Ser. No. 07/926,554, filed Aug. 6, 1992, which is a continuation of co-pending application Ser. No. 07/667,632 filed on Mar. 11, 1992.

BACKGROUND OF THE INVENTION

1. Field of the Invention

This invention relates to a preformed decorative wrap for a gift box.

2. Description of the Prior Art

Gift wrapping entails purchasing a roll of suitable decorative paper, cutting off a piece suitable in size for the carton at hand to be wrapped, attempting to center the carton on the paper and hold it centered while folding the paper about the carton and securing the same.

It is the concept of the invention herein to provide pre-cut sheets of gift wrapping paper of an appropriate size for specified sized gift cartons.

It is a further concept to pre-scribe a sheet of such pre-cut paper with fold lines on the reverse side thereof and have the same numbered for sequential folding and having shield adhesive strips along overlapping edges to secure the same.

The invention herein provides an exact fitting of a preformed gift wrap for each carton wrapped and reduces an otherwise chore to an expedited perfectly fitting gift wrap of a carton.

These and other objects and advantages of the invention will be set forth in the following description made in connection with the accompanying drawings in which like reference characters refer to similar parts throughout the several views.

BRIEF DESCRIPTION OF THE DRAWINGS

FIG. 1 is a plan view of a sheet of gift wrapping paper;

DESCRIPTION OF A PREFERRED EMBODIMENT

Figure 2:
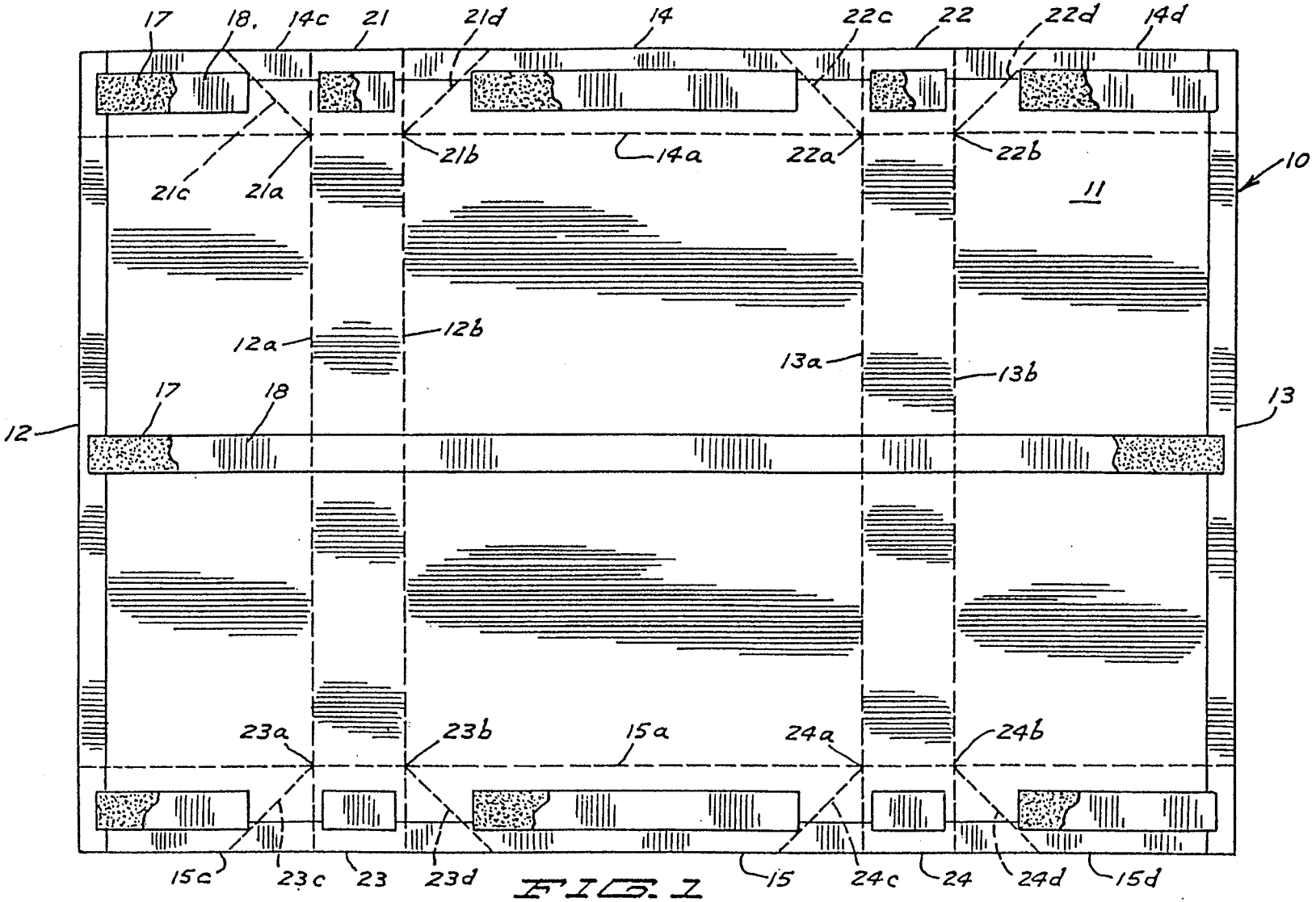
FIG. 2 is a perspective in top plan showing a carton in position to be wrapped.
Figure 2:
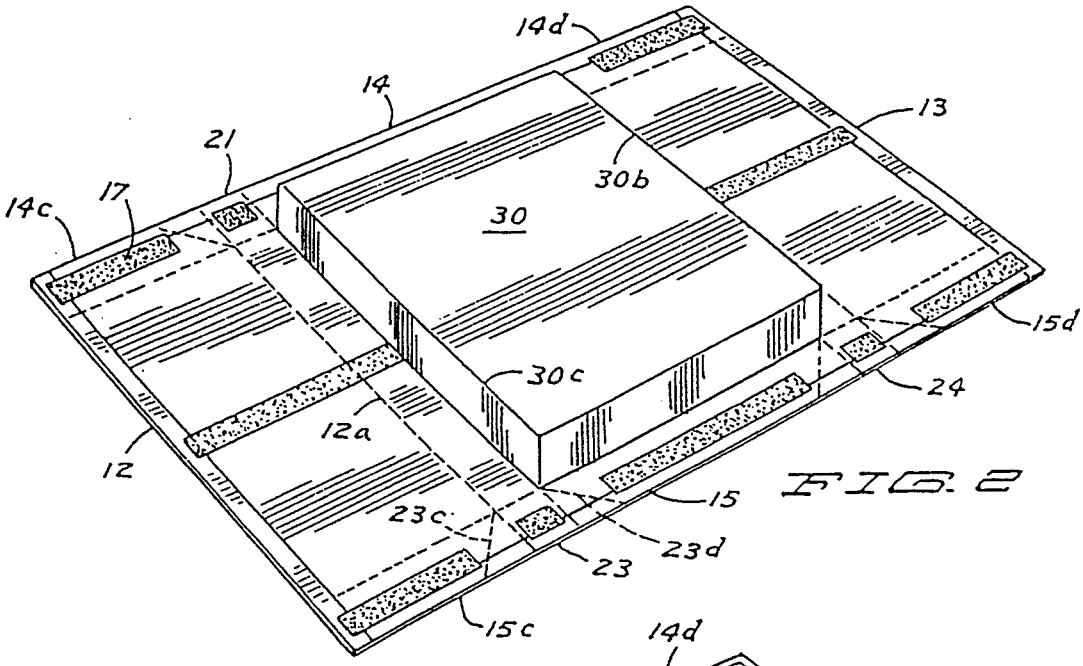

Referring to the drawings and more particularly to FIG. 1, a plan view of a preformed sheet of gift wrapping paper or wrap 10 is shown with the reverse or inner side 11 thereof being shown.

Said sheet 10 has outer side edges 12 and 13 and end edges 14 and 15 having outer end portions **14*c*–14*d* and 15*c*–15*d*. Spaced inwardly from said outer edges are marked or scribed inner side lines 12*a*–12*b* and 13*a*–13*b* spaced apart the width and depth of the carton to be contained therebetween and inwardly of the ends are lines 14*a* and 15*a*** spaced apart the length of the carton to be positioned and contained therebetween. Said lines may be merely printed but preferably are scored or creased to aid in folding.

Overlying the inner sides of said edges 14 and 15 and transversely centrally of said wrap, as are appropriate, are adhesive coated strips 17 applied to the wrap and protected by cover stripping 18.

It is seen that the lines **12*a*–12*b* and 13*a*–13*b* and the lines 14*a* and 15*a* respectively intersect adjacent their ends to form what become corner walls 21–24 as will be seen. From the points of intersection 21*a*–*b*–24*a*–*b*, fold lines are indicated at 21*c*, 21*d*, 22*c*, 22*d*, 23*c*, 23*d*, 24*c*, and 24*d***. These fold lines are angled at 45° to the adjacent intersecting lines.

Figure 3:
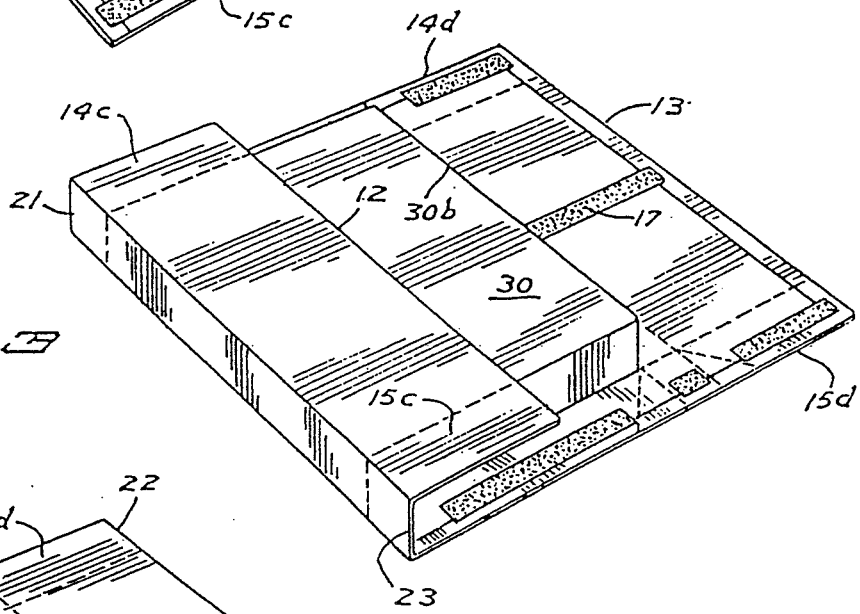
FIGS. 3–7 in perspective show the progressive steps in wrapping a carton.
Figure 4:
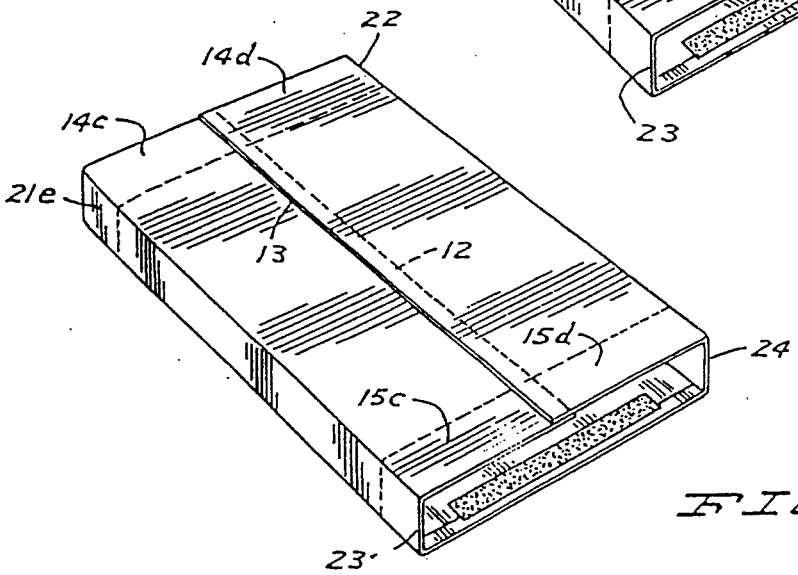

The wrap is now ready to be placed about a carton. The cover stripping 18 is removed from the adhesive stripping 17, as a carton 30 is positioned upon the wrap. Referring to FIGS. 3 and 4, the side 12 of the wrap is brought up over the adjacent side **30*a* of said carton. Next the side 13 is brought up over its adjacent side 30*b* of said carton and overlies an edge of the side 12. Said central strip 17 is pressed down and secured to the underlying carton and the adjacent edge portion of side 12**. This leaves the end corners boxed-in as illustrated.

Figure 5:
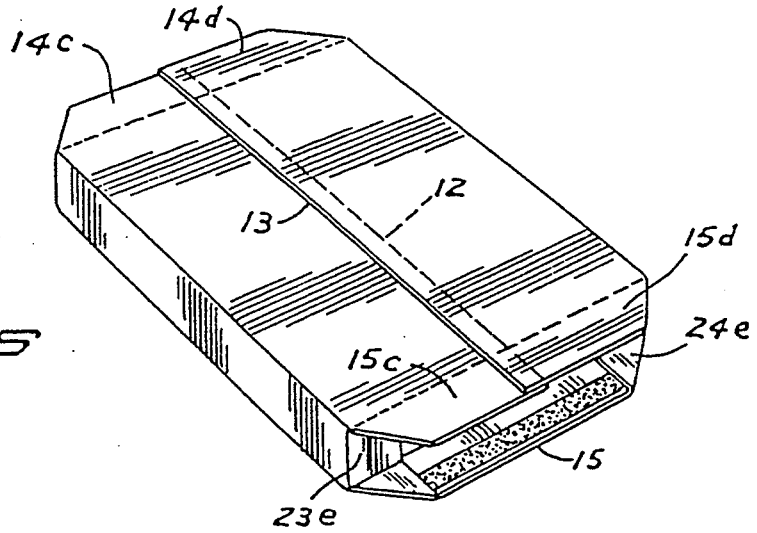
Figure 6:
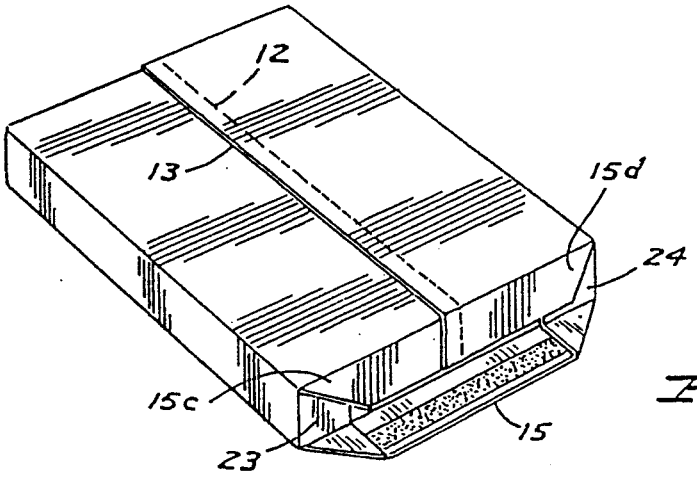
Figure 7:
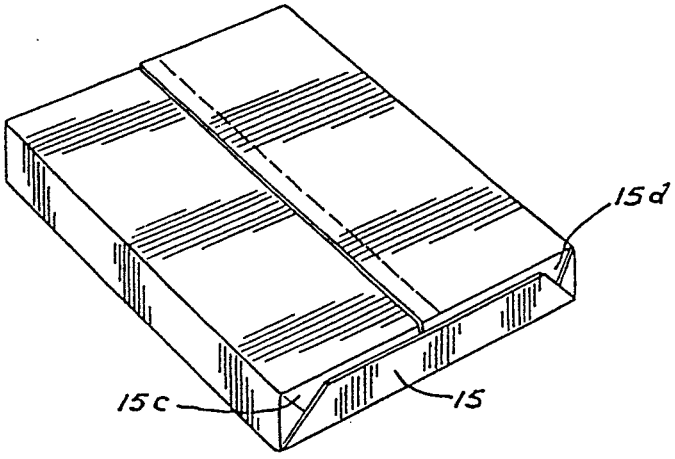

Starting with the corner or corner wall 23, it is folded inwardly on its fold lines **23*c* and 23*d* and in like manner the corner wall 21 is folded inwardly on its fold lines 21*c* and 21*d*. In like manner the corners 22 and 24 are folded inwardly whereby said wrap and carton now appears as in FIGS. 5 and 6. The upper or overlying end portions 15*c* and 15*d* are folded and secured downwardly as indicated in FIG. 6 and the underlying central end portion 15 is folded upwardly and secured by pressure upon the underlying adhesive. The end portion 14** is likewise folded though not here shown. Thus a quick wrapping of the carton is completed.

Thus it is seen that there has been provided a very simple expedited method for applying a preformed gift wrap to a carton with no additional supplies being required for the wrapping.

It will of course be understood that various changes may be made in the form, details, arrangement and proportions of the product without departing from the scope of the invention which, generally stated, consists in a product capable of carrying out the objects above set forth, in the parts and combination of parts disclosed and defined in the appended claims.

What is claimed is:

1. A wrap for wrapping a carton comprising:

a. a generally rectangular, four cornered sheet of wrapping material having a perimeter defined by a pair of outer edges, said pair of outer edges including a first outer edge generally spaced parallel from a second outer edge, and a pair of end edges, said pair of end edges including a first end edge generally spaced parallel from a second end edge, wherein said outer edges intersect said end edges to form said four corners of said generally rectangular sheet;

b. a first adhesive means, said first adhesive means attached to said sheet proximate said first outer edge over the length thereof to form a generally linear first adhesive strip generally parallel to said first outer edge;

c. a second adhesive means, said second adhesive means attached to said sheet proximate said second outer edge over the length thereof to form a generally linear second adhesive strip generally parallel to said second outer edge; and, d. a third adhesive means, said third adhesive means attached to said sheet intermediate between and generally parallel to said first and said second adhesive means over the length of said outer edges to form a generally linear third adhesive strip.

2. The wrap of claim 1 wherein said adhesive means include a combination of continuous and discontinuous strips of adhesive material deposited on said sheet.

3. The wrap of claim 1 further comprising means removably attached to said first, second and third adhesive means for covering said adhesive material.

4. The wrap of claim 1 including a plurality of lateral lines disposed on said sheet.

5. A wrap for wrapping a carton comprising:

a. a generally rectangular, four cornered sheet of wrapping material having a pair of outer edges, said pair of outer edges including a first outer edge generally spaced parallel from a second outer edge wherein a distance between said pair of outer edges defines a width of said sheet;

b. a first generally linear adhesive strip attached to said sheet proximate said first outer edge and generally parallel to said first outer edge over the length thereof;

c. a second generally linear adhesive strip attached to said sheet proximate said second outer edge and generally parallel to said second outer edge over the length thereof; and, d. a third generally linear adhesive strip attached to said sheet intermediate between and generally parallel to said first and said second generally linear adhesive strips over the length of said pair of outer edges.

6. The wrap of claim 5 wherein said first, second and third adhesive strips comprise a combination of continuous and discontinuous strips of adhesive material deposited on said sheet.

7. The wrap of claim 5 further comprising means removably attached to said first, second and third adhesive strips for covering said adhesive material.

8. The wrap of claim 7 including a plurality of lateral lines disposed on said sheet.

* * * * *